US011045868B2

(12) United States Patent
Hoevelmann et al.

(10) Patent No.: US 11,045,868 B2
(45) Date of Patent: Jun. 29, 2021

(54) METHOD FOR CONTROLLING A CONTINUOUS CASTING SYSTEM

(71) Applicants: Thyssenkrupp AG, Essen (DE); Thyssenkrupp Hohenlimburg GmbH, Hagen (DE)

(72) Inventors: Friedrich Hoevelmann, Schwerte (DE); Raphael Markowitsch, Dortmund (DE); Peter Manthey, Froendenberg (DE)

(73) Assignee: Thyssenkrupp AG, Essen (DE)

( * ) Notice: Subject to any disclaimer, the term of this patent is extended or adjusted under 35 U.S.C. 154(b) by 210 days.

(21) Appl. No.: 16/277,229

(22) Filed: Feb. 15, 2019

(65) Prior Publication Data

US 2019/0255602 A1 Aug. 22, 2019

(30) Foreign Application Priority Data

Feb. 21, 2018 (DE) ..... 102018202651.3

(51) Int. Cl.

| | |
|---|---|
| ***B22D 11/16*** | (2006.01) |
| ***B22D 11/05*** | (2006.01) |
| ***B22D 11/04*** | (2006.01) |
| ***B22D 11/126*** | (2006.01) |
| ***B22D 11/14*** | (2006.01) |

(Continued)

(52) U.S. Cl.

CPC ..... *B22D 11/168* (2013.01); *B22D 11/0403* (2013.01); *B22D 11/05* (2013.01); *B22D 11/126* (2013.01); *B22D 11/147* (2013.01); *B22D 11/163* (2013.01); *B22D 11/053* (2013.01); *B22D 11/055* (2013.01)

(58) Field of Classification Search

CPC ..... B22D 11/168; B22D 11/05; B22D 11/053; B22D 11/055; B22D 11/16; B22D 11/20; B22D 11/203; B22D 11/0403; B22D 11/126; B22D 11/147; B22D 11/163

See application file for complete search history.

(56) References Cited

U.S. PATENT DOCUMENTS 6,665,572 B2 * 12/2003 Buervenich ..... B22D 11/16 700/100

FOREIGN PATENT DOCUMENTS

| | | |
|---|---|---|
| EP | 1021261 B1 | 5/2002 |
| EP | 1658533 B1 | 5/2008 |

* cited by examiner

*Primary Examiner* — Kevin P Kerns
*Assistant Examiner* — Steven S Ha
(74) *Attorney, Agent, or Firm* — Harness, Dickey & Pierce, P.L.C.

(57) ABSTRACT

A method of controlling a continuous casting system for producing slabs from a material, the continuous casting system having a number of molds for forming corresponding strands, the method including receiving a plurality of casting orders, determining for each of the casting orders a set of slabs to be cast, sorting the slabs to be cast of the sets of the casting orders to obtain a sorted base sequence, uniformly partitioning the sorted base sequence into a number of subsequences, adjusting slab widths of the slabs to be cast of the subsequence, wherein, due to the adjustment, the width changes between two slabs to be cast immediately one after the other in the subsequence do not exceed a step value, wherein adjusted subsequences are obtained from the adjusted slab widths, transmitting control data to the continuous casting system for producing the slabs to be cast determined in the adjusted subsequences.

18 Claims, 8 Drawing Sheets

Figure 1:
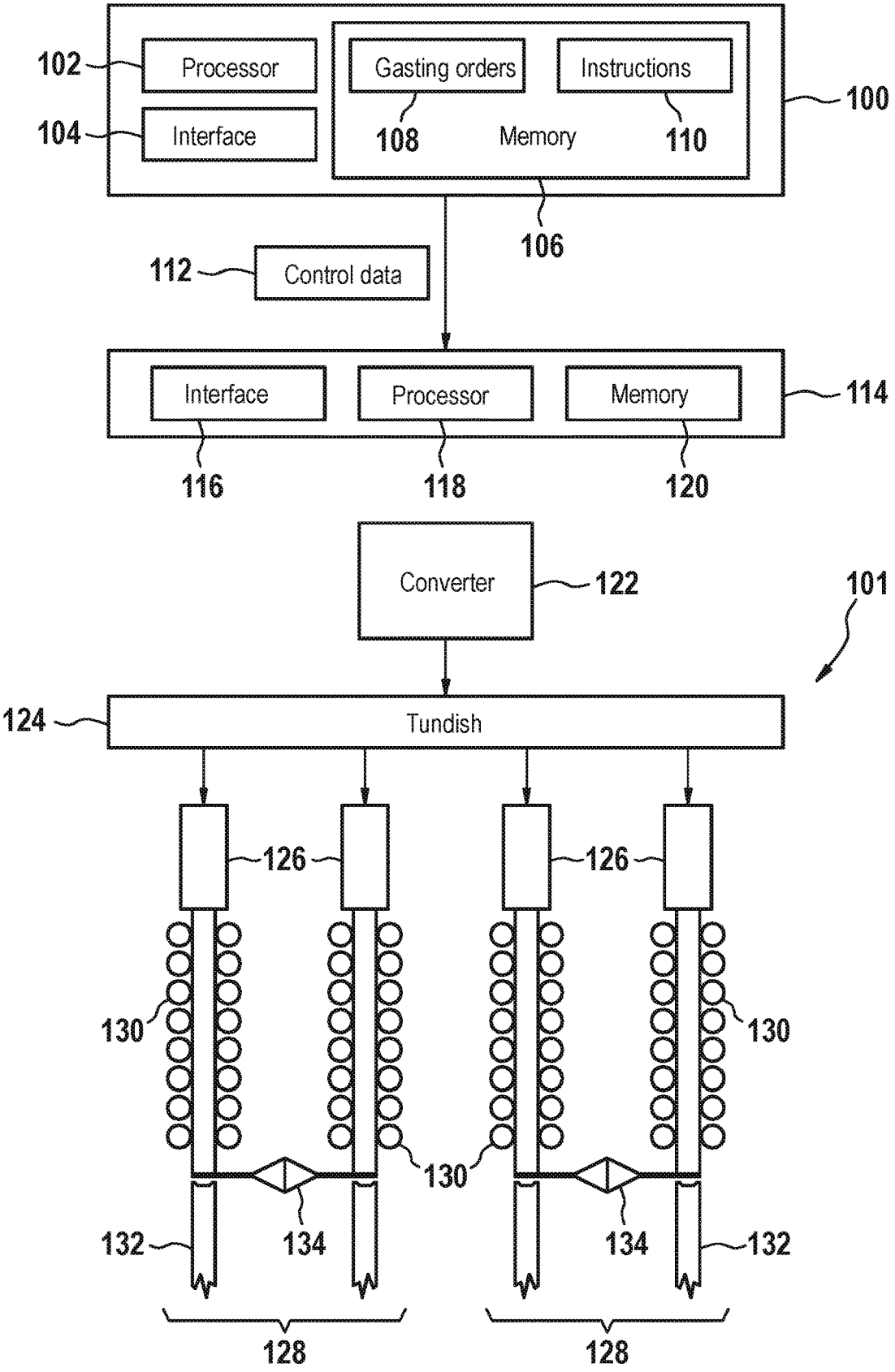

(51) Int. Cl.

| | |
|---|---|
| *B22D 11/053* | (2006.01) |
| *B22D 11/055* | (2006.01) |

Fig. 3

1. Casting orders with the most important tolerance specifications

| | Demand quantity | Rolling width | Width min | Width max | KIM min | KIM max | HZ Weight min | HZ Weight max |
|---|---|---|---|---|---|---|---|---|
| Order 1 | 50000 | 520 | 490 | 550 | 15 | 20 | 7959 | 10192 |
| Order 2 | 35000 | 650 | 620 | 680 | 15 | 20 | 9949 | 12740 |
| Order 3 | 30000 | 400 | 370 | 430 | 15 | 20 | 6122 | 7840 |
| Order 4 | 40000 | 470 | 440 | 500 | 15 | 20 | 8153 | 9212 |
| Order 5 | 45000 | 550 | 520 | 580 | 15 | 20 | 8418 | 10780 |
| Order 6 | 40000 | 600 | 570 | 630 | 15 | 20 | 9184 | 11760 |
| Order 7 | 40000 | 430 | 400 | 460 | 15 | 18 | 6582 | 7585 |
| | 280000 | | | | | | | |

Fig. 4

2. Translation of specifications in specifications for slabs, in particular translation of demand quantity in a number pieces

| | average slab weight | amount of slabs | demand-quantity of slabs | Rolling width | Width min | Width max | KIM min | KIM max | HZ Weight min | HZ Weight max |
|---|---|---|---|---|---|---|---|---|---|---|
| Order 1 | 9076 | 6 | 54456 | 520 | 490 | 550 | 15 | 20 | 7959 | 10192 |
| Order 2 | 11345 | 3 | 34035 | 650 | 620 | 680 | 15 | 20 | 9949 | 12740 |
| Order 3 | 6981 | 4 | 27924 | 400 | 370 | 430 | 15 | 20 | 6122 | 7840 |
| Order 4 | 8683 | 5 | 43415 | 470 | 440 | 500 | 15 | 20 | 8153 | 9212 |
| Order 5 | 9599 | 5 | 47995 | 550 | 520 | 580 | 15 | 20 | 8418 | 10780 |
| Order 6 | 10472 | 4 | 41888 | 600 | 570 | 630 | 15 | 20 | 9184 | 11760 |
| Order 7 | 7084 | 6 | 42504 | 430 | 400 | 460 | 15 | 18 | 6582 | 7585 |
| | | 33 | 292217 | | | | | | | |

Fig. 5

3. Determine the base sequence

| | | Rolling width | Width min | Width max | KIM min | KIM max | HZ Weight min | HZ Weight max |
|---|---|---|---|---|---|---|---|---|
| T1 | Order 2 | 650 | 620 | 680 | 15 | 20 | 9949 | 12740 |
| | Order 2 | 650 | 620 | 680 | 15 | 20 | 9949 | 12740 |
| | Order 2 | 650 | 620 | 680 | 15 | 20 | 9949 | 12740 |
| | Order 6 | 600 | 570 | 630 | 15 | 20 | 9184 | 11760 |
| | Order 6 | 600 | 570 | 630 | 15 | 20 | 9184 | 11760 |
| | Order 6 | 600 | 570 | 630 | 15 | 20 | 9184 | 11760 |
| | Order 6 | 600 | 570 | 630 | 15 | 20 | 9184 | 11760 |
| | Order 5 | 550 | 520 | 580 | 15 | 20 | 8418 | 10780 |
| T2 | Order 5 | 550 | 520 | 580 | 15 | 20 | 8418 | 10780 |
| | Order 5 | 550 | 520 | 580 | 15 | 20 | 8418 | 10780 |
| | Order 5 | 550 | 520 | 580 | 15 | 20 | 8418 | 10780 |
| | Order 5 | 550 | 520 | 580 | 15 | 20 | 8418 | 10780 |
| | Order 1 | 520 | 490 | 550 | 15 | 20 | 7959 | 10192 |
| | Order 1 | 520 | 490 | 550 | 15 | 20 | 7959 | 10192 |
| | Order 1 | 520 | 490 | 550 | 15 | 20 | 7959 | 10192 |
| | Order 1 | 520 | 490 | 550 | 15 | 20 | 7959 | 10192 |
| T3 | Order 1 | 520 | 490 | 550 | 15 | 20 | 7959 | 10192 |
| | Order 4 | 470 | 440 | 500 | 17 | 20 | 8153 | 9212 |
| | Order 4 | 470 | 440 | 500 | 17 | 20 | 8153 | 9212 |
| | Order 4 | 470 | 440 | 500 | 17 | 20 | 8153 | 9212 |
| | Order 4 | 470 | 440 | 500 | 17 | 20 | 8153 | 9212 |
| | Order 4 | 470 | 440 | 500 | 17 | 20 | 8153 | 9212 |
| | Order 7 | 430 | 400 | 460 | 15 | 18 | 6582 | 7585 |
| T4 | Order 7 | 430 | 400 | 460 | 15 | 18 | 6582 | 7585 |
| | Order 7 | 430 | 400 | 460 | 15 | 18 | 6582 | 7585 |
| | Order 7 | 430 | 400 | 460 | 15 | 18 | 6582 | 7585 |
| | Order 7 | 430 | 400 | 460 | 15 | 18 | 6582 | 7585 |
| | Order 7 | 430 | 400 | 460 | 15 | 18 | 6582 | 7585 |
| | Order 3 | 400 | 370 | 430 | 15 | 20 | 6122 | 7840 |
| | Order 3 | 400 | 370 | 430 | 15 | 20 | 6122 | 7840 |
| | Order 3 | 400 | 370 | 430 | 15 | 20 | 6122 | 7840 |
| | Order 3 | 400 | 370 | 430 | 15 | 20 | 6122 | 7840 |

Fig. 6

4. Partitioning of the base sequence in four subsequences

| Sub sequence = T1 | | | | | | | |
|---|---|---|---|---|---|---|---|
| | Rolling width | Width min | Width max | KI M min | KI M max | HZ Weight min | HZ Weight max |
| Order 2 | 650 | 620 | 680 | 15 | 20 | 9949 | 12740 |
| Order 2 | 650 | 620 | 680 | 15 | 20 | 9949 | 12740 |
| Order 2 | 650 | 620 | 680 | 15 | 20 | 9949 | 12740 |
| Order 6 | 600 | 570 | 630 | 15 | 20 | 9184 | 11760 |
| Order 6 | 600 | 570 | 630 | 15 | 20 | 9184 | 11760 |
| Order 6 | 600 | 570 | 630 | 15 | 20 | 9184 | 11760 |
| Order 6 | 600 | 570 | 630 | 15 | 20 | 9184 | 11760 |
| Order 6 | 550 | 520 | 580 | 15 | 20 | 8418 | 10780 |

| Sub sequence = T2 | | | | | | | |
|---|---|---|---|---|---|---|---|
| | Rolling width | Width min | Width max | KI M min | KI M max | HZ Weight min | HZ Weight max |
| Order 5 | 550 | 520 | 580 | 15 | 20 | 8418 | 10780 |
| Order 5 | 550 | 520 | 580 | 15 | 20 | 8418 | 10780 |
| Order 5 | 550 | 520 | 580 | 15 | 20 | 8418 | 10780 |
| Order 5 | 550 | 520 | 580 | 15 | 20 | 8418 | 10780 |
| Order 1 | 520 | 490 | 550 | 15 | 20 | 7959 | 10192 |
| Order 1 | 520 | 490 | 550 | 15 | 20 | 7959 | 10192 |
| Order 1 | 520 | 490 | 550 | 15 | 20 | 7959 | 10192 |
| Order 1 | 520 | 490 | 550 | 15 | 20 | 7959 | 10192 |

| Sub sequence = T3 | | | | | | | |
|---|---|---|---|---|---|---|---|
| | Rolling width | Width min | Width max | KI M min | KI M max | HZ Weight min | HZ Weight max |
| Order 1 | 520 | 490 | 550 | 15 | 20 | 7959 | 10192 |
| Order 4 | 470 | 440 | 500 | 17 | 20 | 8153 | 9212 |
| Order 4 | 470 | 440 | 500 | 17 | 20 | 8153 | 9212 |
| Order 4 | 470 | 440 | 500 | 17 | 20 | 8153 | 9212 |
| Order 4 | 470 | 440 | 500 | 17 | 20 | 8153 | 9212 |
| Order 4 | 470 | 440 | 500 | 17 | 20 | 8153 | 9212 |
| Order 7 | 430 | 400 | 460 | 15 | 18 | 6582 | 7585 |
| Order 7 | 430 | 400 | 460 | 15 | 18 | 6582 | 7585 |

| Sub sequence = T4 | | | | | | | |
|---|---|---|---|---|---|---|---|
| | Rolling width | Width min | Width max | KI M min | KI M max | HZ Weight min | HZ Weight max |
| Order 7 | 430 | 400 | 460 | 15 | 18 | 6582 | 7585 |
| Order 7 | 430 | 400 | 460 | 15 | 18 | 6582 | 7585 |
| Order 7 | 430 | 400 | 460 | 15 | 18 | 6582 | 7585 |
| Order 7 | 430 | 400 | 460 | 15 | 18 | 6582 | 7585 |
| Order 3 | 400 | 370 | 430 | 15 | 20 | 6122 | 7640 |
| Order 3 | 400 | 370 | 430 | 15 | 20 | 6122 | 7640 |
| Order 3 | 400 | 370 | 430 | 15 | 20 | 6122 | 7640 |
| Order 3 | 400 | 370 | 430 | 15 | 20 | 6122 | 7640 |

Fig. 7

5. Assign to stand allocation scheme (example)

| Main strand 1 | | |

Fig. 8

6. Adjusting substrand lengths in tolerance range

| Main strand 1 | | | | | | | | | | | | | | | | | | | | | | | | | |
|---|---|---|---|---|---|---|---|---|---|---|---|---|---|---|---|---|---|---|---|---|---|---|---|---|---|
| Substrand 1 = T3 | | | | | | | | | | | | | Substrand 2 = T2 | | | | | | | | | | | | |
| | Rolling width | Width min | Width max | KI M min | KI M max | HZ Weight min | HZ Weight max | Strand width | Length min | Length max | Strands length | Strand weight | | Rolling width | Width min | Width max | KI M min | KI M max | HZ Weight min | HZ Weight max | Strand width | Length min | Length max | Strands length | Strand weight |
| Order 1 | 520 | 490 | 550 | 15 | 20 | 7959 | 10192 | 500 | 7849 | 10051 | 8757 | 8880 | Order 5 | 550 | 520 | 580 | 15 | 20 | 8418 | 10780 | 550 | 7547 | 9665 | 8757 | 7968 |
| Order 4 | 470 | 440 | 500 | 17 | 20 | 8153 | 9212 | 475 | 8464 | 9563 | 9065 | 8732 | Order 5 | 550 | 520 | 580 | 15 | 20 | 8418 | 10780 | 550 | 7547 | 9665 | 9065 | 10111 |
| Order 4 | 470 | 440 | 500 | 17 | 20 | 8153 | 9212 | 470 | 8554 | 9665 | 9110 | 8683 | Order 5 | 550 | 520 | 580 | 15 | 20 | 8418 | 10780 | 550 | 7547 | 9665 | 9110 | 10161 |
| Order 4 | 470 | 440 | 500 | 17 | 20 | 8153 | 9212 | 470 | 8554 | 9665 | 9154 | 8725 | Order 5 | 550 | 520 | 580 | 15 | 20 | 8418 | 10780 | 545 | 7616 | 9753 | 9154 | 10118 |
| Order 4 | 470 | 440 | 500 | 17 | 20 | 8153 | 9212 | 470 | 8554 | 9665 | 9110 | 8683 | Order 1 | 520 | 490 | 550 | 15 | 20 | 7959 | 10192 | 520 | 7547 | 9665 | 9110 | 9607 |
| Order 4 | 470 | 440 | 500 | 17 | 20 | 8153 | 9212 | 455 | 8836 | 9983 | 9251 | 8536 | Order 1 | 520 | 490 | 550 | 15 | 20 | 7959 | 10192 | 520 | 7547 | 9665 | 9251 | 9756 |
| Order 7 | 430 | 400 | 460 | 15 | 18 | 6582 | 7585 | 430 | 7584 | 8698 | 8607 | 7506 | Order 1 | 520 | 490 | 550 | 15 | 20 | 7959 | 10192 | 520 | 7547 | 9665 | 8607 | 9077 |
| Order 7 | 430 | 400 | 460 | 15 | 18 | 6582 | 7585 | 430 | 7584 | 8698 | 8607 | 7506 | Order 1 | 520 | 490 | 550 | 15 | 20 | 7959 | 10192 | 520 | 7547 | 9665 | 8607 | 9077 |
| | | | | | | | | | | | 71661 | 67251 | | | | | | | | | | | | 71661 | 77675 |

Fig. 9

7. Example of adjustment of the weights by changing the lengths in tolerance range

| Substrand 1 = T3 | | | | | | | | | | | | |
|---|---|---|---|---|---|---|---|---|---|---|---|---|
| | Rolling width | Width min | Width max | KI M min | KI M max | HZ Weight min | HZ Weight max | Strand width | Length min | Length max | Strands length | Strand weight |
| Order 1 | 520 | 490 | 550 | 15 | 20 | 7959 | 10192 | 500 | 7849 | 10051 | 9500 | 9633 |
| Order 4 | 470 | 440 | 500 | 17 | 20 | 8153 | 9212 | 475 | 8464 | 9563 | 9500 | 9151 |
| Order 4 | 470 | 440 | 500 | 17 | 20 | 8153 | 9212 | 470 | 8554 | 9665 | 9500 | 9055 |
| Order 4 | 470 | 440 | 500 | 17 | 20 | 8153 | 9212 | 470 | 8554 | 9665 | 9500 | 9055 |
| Order 4 | 470 | 440 | 500 | 17 | 20 | 8153 | 9212 | 470 | 8554 | 9665 | 9500 | 9055 |
| Order 4 | 470 | 440 | 500 | 17 | 20 | 8153 | 9212 | 455 | 8836 | 9983 | 9500 | 8766 |
| Order 7 | 430 | 400 | 460 | 15 | 18 | 6582 | 7585 | 430 | 7584 | 8696 | 8650 | 7543 |
| Order 7 | 430 | 400 | 460 | 15 | 18 | 6582 | 7585 | 430 | 7584 | 8696 | 8650 | 7543 |
| | | | | | | | | | | | | 69801 |

| Substrand 2 = T2 | | | | | | | | | | | | |
|---|---|---|---|---|---|---|---|---|---|---|---|---|
| | Rolling width | Width min | Width max | KI M min | KI M max | HZ Weight min | HZ Weight max | Strand width | Length min | Length max | Strands length | Strand weight |
| Order 5 | 550 | 520 | 580 | 15 | 20 | 8418 | 10780 | 550 | 7547 | 9665 | 9500 | 10596 |
| Order 5 | 550 | 520 | 580 | 15 | 20 | 8418 | 10780 | 550 | 7547 | 9665 | 9500 | 10596 |
| Order 5 | 550 | 520 | 580 | 15 | 20 | 8418 | 10780 | 550 | 7547 | 9665 | 9500 | 10596 |
| Order 5 | 550 | 520 | 580 | 15 | 20 | 8418 | 10780 | 545 | 7616 | 9753 | 9500 | 10500 |
| Order 1 | 520 | 490 | 550 | 15 | 20 | 7959 | 10192 | 520 | 7547 | 9665 | 9500 | 10018 |
| Order 1 | 520 | 490 | 550 | 15 | 20 | 7959 | 10192 | 520 | 7547 | 9665 | 9500 | 10018 |
| Order 1 | 520 | 490 | 550 | 15 | 20 | 7959 | 10192 | 520 | 7547 | 9665 | 8650 | 9122 |
| Order 1 | 520 | 490 | 550 | 15 | 20 | 7959 | 10192 | 520 | 7547 | 9665 | 8650 | 9122 |
| | | | | | | | | | | | | 80568 |

METHOD FOR CONTROLLING A CONTINUOUS CASTING SYSTEM

CROSS-REFERENCE TO RELATED APPLICATIONS

The present application claims priority under 35 U.S.C. § 119 to German Patent Application No. 102018202651.3, filed on Feb. 21, 2018, in the Korean Intellectual Property Office, the entire contents of each of which are hereby incorporated by reference.

The invention relates to a method for controlling a continuous casting system, a computer program product and a control device for controlling a continuous casting system.

Continuous casting systems are used for the production of slabs from various materials such as steels, copper alloys or aluminum. A corresponding melt is transported to the continuous casting system and poured from a converter into a casting ladle. Via a bottom outlet the melt then flows from the ladle into a tundish from which the melt can flow into so-called molds. Each mold determines the shape of the strand which is cast. In order to prevent the material from caking on the walls of the mold, the mold is oscillating moved. Due to the cooling of the walls of the mold, the material solidifies at the edges, resulting in a solidified strand shell which is cooled further after leaving the mold. The strand shell or the strand in general is still supported by rollers after leaving the mold in order to prevent the strand from breaking open.

Once the strand has solidified in its cross-section, it can be cut to the desired length by an appropriate cutting system, e.g. a cutting torch or scissors.

As a result, the continuous casting process results in individual slabs which can for example then be further processed in a rolling mill. One possibility, for example, is hot rolling, in which the slabs are heated to a corresponding temperature above the recrystallization temperature and then reduced to the specified thickness in the gap of a hot rolling mill by exerting pressure. Since the volume of the slab remains the same, changes in length and width occur. Due to the rolling process, a slab finally becomes a strip which is wound onto a reel to form a coil.

Continuous casting systems are used in various configurations. So-called multiple strand systems, in which several strands can be cast in parallel and simultaneously, are common. Here, the tundish has the function of distributing the liquid material, such as liquid steel, to the individual molds and thus the individual strands.

EP 1021261 B 1 describes, for example, a process and a system for the production of slabs of various formats. The EP 1658533 B1 reveals a method and a device for controlling a plant for the production of steel.

The invention has as its object to provide for a method for controlling a continuous casting system for the production of slabs, a computer program product and a control device for controlling a continuous casting system for the production of slabs. The object is achieved by the features of the independent patent claims. Preferred embodiments of the invention are given in the dependent claims.

A method for controlling for controlling a continuous casting system for producing slabs from a predetermined material is presented, wherein the continuous casting system has a plurality of molds for forming respective strands, wherein the method comprises:

receiving a plurality of casting orders, each casting order comprising a demand quantity of the material, an associated slab width, and tolerance specifications with respect to the casting order, determining, for each of the casting orders, from the respective demand quantity and the respective slab width, a set of slabs to be cast with associated slab weights and slab widths, sorting all slabs to be cast of all sets of all casting orders according to a sorting criterion to obtain a sorted base sequence of slabs to be cast, the sorting criterion comprising the slab widths, uniformly partitioning the sorted base sequence into a number of subsequences, the number of subsequences corresponding to the number of molds, adjusting, for each of the subsequences, the slab widths of the slabs to be cast of the subsequence under consideration of the tolerance specifications, wherein as a result of the adjusting of the width changes between two slabs to be cast immediately successively one after the other in the subsequence do not exceed a predetermined step value, wherein adjusted subsequences are obtained as a result of the adjusted slab widths, transmitting control data to the continuous casting system for producing the slabs to be cast determined in the adjusted subsequences, wherein in the control data for each of the subsequences the order of production of the slabs corresponds to the order in which the slabs to be cast are determined in the respective adjusted subsequence.

Embodiments of the invention could have the advantage that the quantity of scrap (i.e. the production of stock slabs not currently included in the orders) could be reduced by the optimized production of the slabs, thus maximizing the casting performance of the continuous casting system. Due to the sorting criteria, the batch purity (one converter filling) of the individual casting orders and thus of the assigned customer orders is also improved, which reduces the sampling effort for these orders, since one sampling per order is required. The latter is relevant because the coils must meet certain quality criteria with regard to the materials used. For this reason, one sample must be taken per batch (i.e. per melt) to check the material quality.

The term "control" of the continuous casting system is generally understood to mean that the continuous casting system receives the continuous casting data from which the actual continuous casting program can be created. The control data contain all information concerning the slabs to be produced with regard to the production sequence as well as their materials and sizes. The continuous casting data thus specify the casting sequence, for example the slab widths and slab lengths to be produced, from which a control program or continuous casting program for the corresponding control of the molds, the transport speed of the strand etc. can then be created in the continuous casting system.

According to an embodiment of the invention, the continuous casting system is a multiple strand system with a plurality of strands arranged in parallel, wherein one of the molds is assigned to each strand, wherein the control is performed for parallel simultaneous production of the slabs to be cast determined in the subsequences. The control data can, for example, specify in which order which slabs with which width are to be produced in parallel and simultaneously.

In this case, the method includes a unique assignment of each of the subsequences to one of the strands, wherein the assignment is carried out in such a way that the average slab width of the slabs to be cast determined in the respective subsequences continuously decreases from the inner strands to the outer strands. This could lead to an increase in the quality of the slabs produced, since the quantities of material flowing out of the tundish are regularly distributed through the corresponding casting tubes into the corresponding molds: in the middle, the largest material discharges take place through the pouring tubes, whereas the material discharges are reduced with respect to the external pouring tubes and molds. All in all, this could prevent corresponding turbulence of the liquid material in the tundish.

According to an embodiment of the invention, due to the uniform partitioning, the number of slabs to be cast determined in the respective subsequences is identical for all subsequences. All casting orders on which the partial sequence formation is based are fully taken into account. By suitable adaptation of the slab lengths, the strand lengths of the individual subsequences can be adjusted to each other without changing the total weight of all partial strands. By the associated shortening of the maximum partial strand length, the total casting time with regard to the casting orders could also be minimized, whereby the overall utilization of the system and thus the casting performance can be further optimized.

It should be noted at this point, that uniform partitioning in the sense of the present description means that segments of the sorted base sequence continue to be used unchanged as subsequences, while the sorting contained within the segments with regard to the slabs is retained. If, for example, the base sequence describes 20 slabs to be cast, a uniform partitioning could be such that slabs 1 to 5 are contained in a first subsequence, slabs 6 to 10 in a second subsequence, slabs 11 to 15 in a third subsequence and slabs 16 to 20 in a fourth subsequence. So to speak, only a photographic cutting of the slabs to be cast, which are described in the sorted basic sequence, takes place.

According to an embodiment of the invention, the method further comprises after the adjusting of the slab widths:

determining the total weight of all slabs to be cast of all adjusted subsequences, comparing the total weight with a target weight for obtaining a comparison value, for all slabs to be cast determined in the adjusted subsequences, changing the slab weight or the slab length in a similar way based on the comparison value for obtaining updated adjusted subsequences, wherein in case when the thereby changed slab weight or the thereby changed slab length violates the tolerance specifications of the associated casting order no change in slab weight or slab length occurs, repeating the steps of the determining of the total weight, the comparing, and the changing of the slab weight or the slab length until the comparison value is within a predetermined threshold range.

This could help to ensure that the entire target quantity is planned on an order-by-order basis when casting orders are primarily specified and that order-less additional slabs to achieve the target weights are avoided.

This could also help to maximize the casting performance of the system by adhering to and exploiting the tolerance data for casting orders, as the threshold range and target weight can be selected in such a way that the available quantity of material from which the slabs are cast is optimally utilized. For example, the target weight is at least an integer multiple of the weight that can be obtained by supplying the material from a converter. If, for example, the total weight of the slabs to be cast from the adjusted sequences is initially 275 tons, whereas only 270 tons can be obtained with one converter, for example, this would mean that a further casting process would have to be carried out with another converter for the difference of five tons, whereby 265 tons of melt could not initially be used for this purpose. If the tolerance specifications for the casting orders are used and "exploited to the full", the method described could optimize the dimensioning of the slabs to be produced to such an extent that their total weight lies at the desired 270 tons and thus the casting orders can be fulfilled with just one converter of melt.

The comparison value includes, for example, the quotient of total weight and target weight, whereby the change in slab weight or slab length includes a multiplication of the slab weight or slab length by the quotient. This could make it easy to quickly and purposefully optimize the total weight in one or more iterations. For example, the threshold range could be a deviation of the total weight from the target weight<3%.

According to an embodiment of the invention, the method further comprises after the adjusting of the slab widths for all of the slabs to be cast of all of the adjusted subsequences, changing the slab width of each slab in a similar way with concomitant shortening of its slab length while retaining its slab weight, wherein in case when the thereby changed slab width or the thereby changed slab length violates the tolerance specifications of the associated casting order no change in the slab width or the slab length occurs.

This could have the advantage of reducing casting times by achieving shorter strand lengths with higher widths. If it is assumed that the throughput speed of the strands through the system is constant or that the length of the slab produced per unit of time is constant, this reduction in the slab length while maintaining the slab weight and correspondingly increasing the slab width leads to a reduction in the time required to carry out the casting program.

For instance, the sorting criterion comprises a decreasing order of the slab widths, wherein the changing of the slab width of each slab in a similar way with concomitant shortening of its slab length comprises for all slabs of an adjusted subsequence respectively:

determining a first quotient of maximum allowable slab width and width of the current slab, determining a second quotient of the width of the slab immediately preceding the current slab in the subsequence and the width of the current slab (132), the second quotient being determined only if the current slab is not the first slab in the subsequence, determining a third quotient of the width of the slab immediately following the current slab in the subsequence plus the step value and the width of the current slab (132), wherein the third quotient is determined only if the current slab is not the last slab in the subsequence.

While the first quotient first takes into account the possible tolerances with regard to the slabs, the second quotient ensures that the strand is not set up. Setting up means that in the sequence the successor of the current slab suddenly becomes wider than its predecessor, i.e. suddenly a width adjustment towards larger widths takes place, but this is however not desired. Starting from the initial sorting of the slabs to be cast according to the sorting criterion of the decreasing slab widths, it is desired that the width adjustment always takes place towards smaller widths in order to optimize the casting performance of the system. Finally, the third quotient serves to avoiding a jump in width to the successor, which cannot be performed by the system.

According to an embodiment of the invention, the changing of the slab width of each slab in a similar way with concomitant shortening of its slab length comprises for all slabs of an adjusted subsequence respectively:

multiplying the width of the current slab and division of the length of the current slab by the smallest value of the first, second and third quotients, repeating the steps of the determining of the first, second and third quotients and the multiplying until either the width of the slabs no longer changes or a predetermined number of iterations is reached or exceeded.

By multiplying by the smallest value of the quotients, it could be ensured that the strand widths can actually be varied in an optimized way in such a way that an optimization of the casting sides by short slabs at high widths is actually possible, since the process could then approach the optimal strand widths and strand lengths in small steps without overshooting the target.

According to an embodiment of the invention, the continuous casting system has, for each pair of strands, a common cutting system for the two strands for cutting slabs cast in parallel, wherein, for a pair of adjusted subsequences associated with one of the pairs of strands, the slabs specified at the same position of the respective subsequences form a pair of slabs to be cast in parallel, wherein the determining of the first, second and third quotients is performed for each pair of current slabs of the slabs to be cast in parallel, wherein the changing of the slab width of each slab in a similar way with concomitant shortening of its slab length comprises for all the slabs of all the pairs of the adjusted subsequences respectively:

multiplying the widths of the pair of current slabs and dividing the lengths of the pair of current slabs by the smallest of the values of the first, second and third quotients determined with respect to the pair of current slabs, repeating the steps of the determining of the first, second and third quotients and the multiplying until either there is no change in the width of the slabs or until a predetermined number of iterations has been reached or exceeded.

This could have the advantage that the technical conditions of the system are taken into account, whereby the corresponding cutting system for cutting a strand is only available for a given pair of strands. In practice, however, this means that the two parallel strands can only be cut simultaneously to obtain slabs of identical length. By using the smallest of the quotient values determined for the pair of current slabs, this technical limitation is now taken into account in an optimized step sequence and it is ensured that an optimization of casting times is possible and that strand pairs with the limitation of identical slab lengths are taken into account.

According to an embodiment of the invention, each casting order comprises a KIM weight, wherein the sorting criterion comprises a decreasing order of the slab widths as a primary criterion and the KIM weight as a secondary criterion, wherein the tolerance specifications each comprise a lower limit and an upper limit with respect to the slab widths and the KIM weights.

It should be noted that the use of KIM weights for coils is a standard specification in the processing and production of strip materials such as steel strip. KIM means weight in kilograms per millimeter of coil width. If, for example, the coil width is 570 mm and the coil weight is 10500 kg, this results in a KIM of 18.4 kg/mm. Since the specific weight of the material is now constant, dimensions, weight and KIM can be converted to each other. If, for example, a strip thickness of 3.5 mm and a specific weight of 7.8 kg/dm$^3$ are assumed in the case of strip steel, a corresponding length of strip steel can be calculated from this, namely in the above example the KIM weight of 18.4 kg/mm and a length of 674764 mm. The KIM weight can therefore be used as a width-independent indicator for the slab length, as it can be assumed that the slabs are to be regarded as having a given and constant thickness.

According to an embodiment of the invention, the determining of the set of slabs to be cast comprises for each casting order:

determining a minimum slab weight from the lower limit of the slab width and the lower limit of the KIM weight, determining a maximum slab weight from the upper limit of the slab width and the upper limit of the KIM weight, determining of a mean value of the minimum and the maximum slab weight, determining the required number of slabs to be cast in order to just exceed the required amount of material at the mean value of the slab weight, wherein the set of slabs to be cast is formed by the number of slabs to be cast.

This could have the advantage that the number of slabs corresponding to each casting order can first be determined for each casting order in such a way that there is still sufficient leeway within the given tolerances for the variation of the strand widths or strand lengths for the subsequent optimization steps. All in all, this could guarantee the highest possible flexibility with regard to the execution of the procedure for variation of the continuous casting system.

According to an embodiment of the invention, the adjusting of the slab widths of the slabs to be cast comprises the subsequence:

starting from the first or the last slab to be cast of the subsequence, determining the difference in width between the current slab and the slab immediately following the current slab in the subsequence, if the difference is greater than the step value, reducing the width of the current slab to such an extent that the resulting width difference to the immediately following slab corresponds to the step value, otherwise keeping the width of the current slab.

It is also possible that in this case the reduced width of the current slab violates the associated tolerance specifications, the current slab is set to the minimum permissible width in the tolerance range, and after adjustment of the slab widths for all slabs in the subsequence, the process is repeated in the opposite direction starting from the last or the first slab to be cast.

This could have the advantage that the strand widths are varied in such a way that the width transitions from slab to slab in the subsequence are as compatible as possible. In particular, it could be avoided in this way that width jumps are present which technically cannot be realized at all by the system at the transition from one slab to the next one, so that in this case so-called intermediate slabs or bearing slabs would first have to be inserted into the subsequence in order to realize such width jumps in several steps. However, a bearing slab again means an ineffective utilization of the continuous casting system, since it is uncertain at what point the bearing slab can be used at all. In addition, a storage slab would have to be assigned to another casting order at a later point in time, so that there is no uniform identical quality within the casting order and the resulting slabs.

According to an embodiment of the invention, each casting order comprises a KIM weight, wherein the tolerance specifications each comprise a lower limit and an upper limit with respect to the KIM weights, wherein the continuous casting system has, for each pair of strands, a common cutting system for the two strands for cutting slabs cast in parallel, wherein, for a pair of adjusted subsequences associated with one of the pairs of strands, the slabs specified at the same position of the respective subsequences form a pair of slabs to be cast in parallel, wherein the method further comprises, after the adjusting of the slab widths:

determining, for each slab to be cast of all the subsequences, from the adapted slab widths and the associated lower and upper limits of the KIM weight corresponding minimum and maximum lengths of the slab, for each pair of slabs to be cast in parallel, determining an average value with respect to the both minimum and maximum lengths of the slabs and assigning the average value the length of the both slabs.

On the one hand, this could ensure that an identical length of the produced slabs can be guaranteed with regard to the parallel lower strands belonging to each other. On the other hand, for this special case of a continuous casting system with pairs of strands, each of which has a common cutting system, it could also be ensured that compatible slab lengths are produced here as effectively as possible. Although the continuous casting system has a common cutting system for each pair of strands and the resulting two parallel strands must have the same length, it could still be ensured that the casting performance of the system is maximized, i.e. in the above example the number of necessary bearing slabs is minimized.

In another aspect the invention relates to a computer program product having processor executable instructions for performing the method described above.

In a further aspect the invention relates to a control device for controlling a continuous casting system for producing slabs from a predetermined material, said continuous casting system comprising a plurality of molds for forming respective strands, said control device comprising a processor and a memory, said memory storing instructions executable by said processor, wherein execution of said instructions by said processor controls said control device to: receive a plurality of casting orders, each casting order comprising a demand quantity of the material, an associated slab width, and tolerance specifications with respect to the casting order, determine, for each of the casting orders, from the respective demand quantity and the respective slab width, a set of slabs to be cast with associated slab weights and slab widths, sort all slabs to be cast of all sets of all casting orders according to a sorting criterion to obtain a sorted base sequence of slabs to be cast, the sorting criterion comprising the slab widths, uniformly partition the sorted base sequence into a number of subsequences, the number of subsequences corresponding to the number of molds, adjust, for each of the subsequences, the slab widths of the slabs to be cast of the subsequence under consideration of the tolerance specifications, wherein as a result of the adjusting of the width changes between two slabs to be cast immediately successively one after the other in the subsequence do not exceed a predetermined step value, wherein adjusted subsequences are obtained as a result of the adjusted slab widths, transmit control data to the continuous casting system for producing the slabs to be cast determined in the adjusted subsequences, wherein in the control data for each of the subsequences the order of production of the slabs corresponds to the order in which the slabs to be cast are determined in the respective adjusted subsequence.

It should be noted that the embodiments and examples described above can be combined in any way as long as these combinations are not mutually exclusive.

Figure 2:
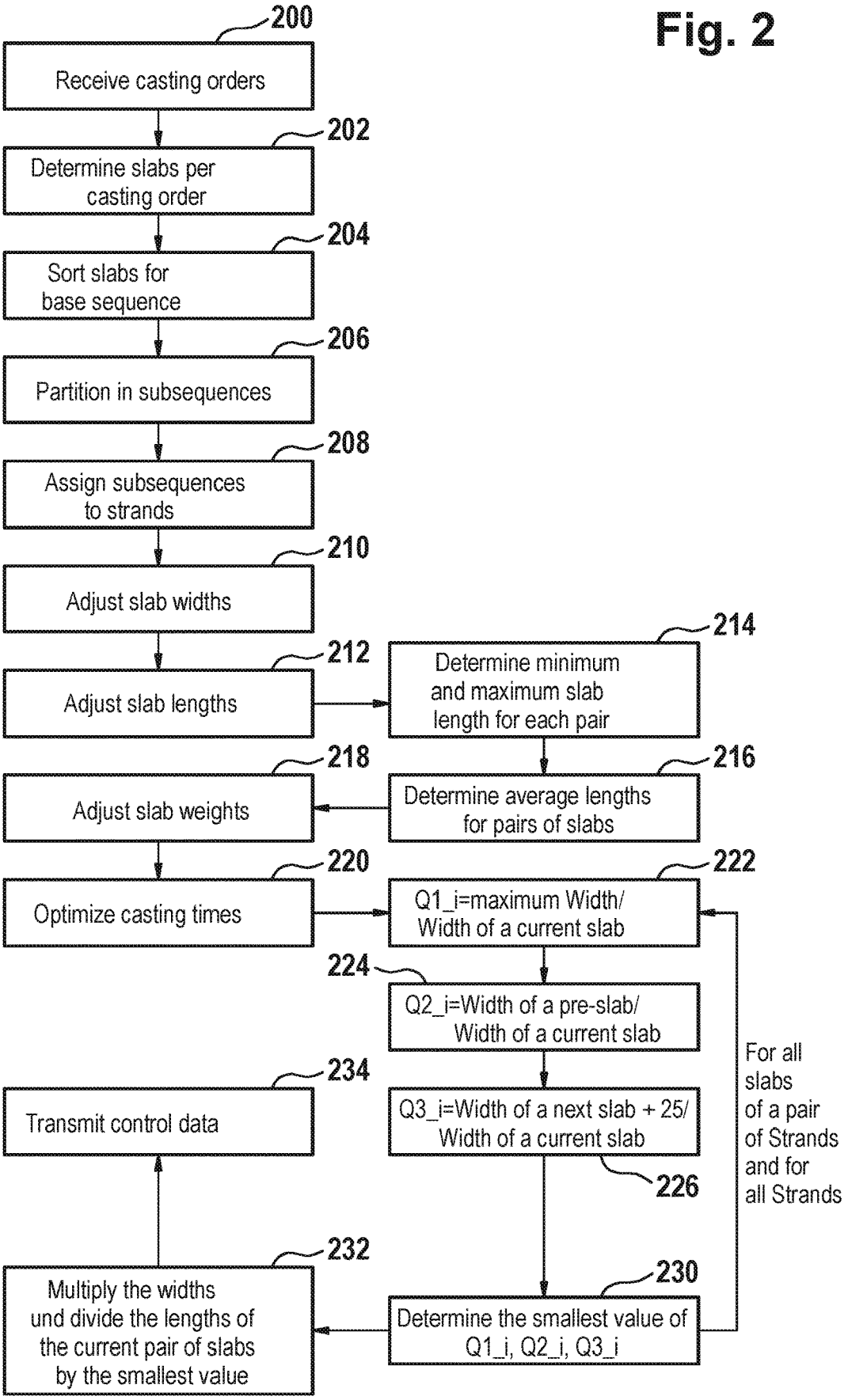

In the following, the preferred embodiments of the invention are explained in more detail using the drawings, wherein:

FIG. 1 shows a system comprising a control device and a continuous casting system, FIG. 2 shows a flow chart of a method for controlling a continuous casting system, FIGS. 3-9 show a translation of various casting orders into corresponding control data for a continuous casting system in tabular form.

In the following, similar elements are marked with the same reference numbers.

FIG. 1 shows a system comprising a control device 100 and a continuous casting system 101. First of all, the continuous casting system 101 is explained in greater detail. A converter 122 is used to provide liquid material. In the following it was assumed without loss of generality that the material is steel so that the converter can take up liquid steel. The liquid steel can be fed into a tundish 124 via a ladle which is not described in detail. In the case of the multiple strand system shown, the tundish then has the function of distributing the liquid steel to the individual strands. In concrete terms, the liquid steel from tundish 124 is fed into ingot molds 126 via casting tubes which are also not shown in detail. The inner sides of the molds are cooled so that solidification of the liquid steel occurs on the inner sides. During casting, the mold is moved in an oscillating motion to prevent the steel from sticking to the cooled walls and to support the transport process. When leaving the mold, the strand now has a solidified shell just a few centimeters thick, while the most of the cross-section is still liquid. The strand is then cooled again and moved on supported by rollers 130.

The result in the example of FIG. 1 is a set of four strands. Also in the example of the continuous casting system in FIG. 1, the two left strands form a pair and the two right strands also form a pair 128. The pair formation is given because a cutting system 134 is provided for each pair 128 of strands, which is intended to cut the strand to obtain individual slabs 132. This leads to the technical limitation that the slabs 132 of a pair 128 of strands must always have identical lengths.

The important control parameters for the products, i.e. the width of the molds 126 and the slab lengths to be produced by the cutting systems 134 as well as the process of continuous casting, i.e. the movement of the strand, the pouring of the liquid steel into the ladle into the tundish, the movement of the mold 126 etc. are controlled by a continuous casting program which is transmitted to the external system via the interface. Memory 120 of a control computer 114 is included. The control computer 114 also has a processor 118 capable of executing the continuous casting program contained in the memory 120 to control the continuous casting system. The control computer 114 also has an interface 116 through which the control computer can receive control data 112 from a control device 100.

The control data 112 determine the slabs to be produced by the continuous casting system. The control data determine the sequence and distribution of the slabs to the individual strands as well as the geometric dimensions of the slabs in detail.

The control unit 100 has a processor 102, an interface 104 and a memory 106. The interface 104 is used to communicate with the interface 116. The memory 106 contains various casting orders 108 and instructions 110. By executing the instruction 110 by the processor 102, the control device 100 is able to carry out the method for casting orders 108 described in FIG. 2 below.

The implementation of the individual process steps discussed in FIG. 2 is shown in the form of a table using various casting orders in FIGS. 3-9.

The method for controlling the continuous casting system 101 begins in step 200 in FIG. 2 with the receipt of the casting orders 108, which are then stored in the memory 106 of the control device 100. FIG. 3 shows various casting orders with the descriptions Order 1, Order 2, . . . Order 7, where, for example, an order quantity of 50 t with a rolling width of 520 mm is given for order 1, whereby tolerance specifications with regard to the rolling width of minimum 490 mm and maximum 550 mm are given here. As the casting orders are all given for the purpose of producing steel coils, a corresponding minimum and maximum KIM weight is also given for each of the casting orders.

However, the fact that coils are to be produced from the slabs is only to be seen as an example of an application—other processing options for slabs are well known to the skilled person.

For Order 1 the minimum KIM weight is 15 kg/mm and the maximum KIM weight is 20 kg/mm. Based on this, an associated semi-finished product weight of at least 7959 kg and a maximum semi-finished product weight of 10192 kg can be calculated for a rolling width of 520 mm, whereby a yield of 98% is taken into account as an example (e.g. 520×15/0.98). In other words, a slab from which a coil with the said rolling width data and KIM weights is made will have a total weight between 7959 kg minimum and 10192 kg maximum.

Each order therefore specifies a required quantity of material (in the example of FIG. 3, order 1 with 50000 kg) as well as an associated slab width, in the example of FIG. 3 for Order 1 with order 1 520 mm and tolerance specifications regarding the widths, again in the example of FIG. 3 for Order 1, the minimum and maximum KIM weight and the resulting slab weights.

First, for each of the orders, a set of slabs to be cast with the corresponding slab weights and slab widths is determined from the respective required quantities and slab widths. From the minimum and maximum semi-finished product weight (slab weight) determined for each order in FIG. 3, an average value can now be determined which corresponds to an amount of 9076 kg for Order 1 in FIG. 3. In order to achieve the required quantity of 50 t for Order 1, a number of six slabs is required, since the required quantity of 50 t is only achieved with a number of six 9076 kg slabs. In the example of Order 1, the quantity that must be produced for Order 1 is even significantly exceeded, namely 54456 kg is achieved by these six slabs with the assumed average slab weight.

The slabs are then sorted in step 204 to obtain a base sequence. Sorting is carried out according to a sorting criterion, whereby the sorting criterion covers the slab widths. Starting from FIG. 4, the rolling widths executed there for each order are now listed and sorted individually from the largest rolling width to the smallest rolling width, whereby the corresponding result is shown in FIG. 5. Order 2 with the largest rolling width of 650 mm appears with the number of the determined slabs of three initially in the top three lines of the base sequence of FIG. 5, followed by the four slabs for Order 6 with 600 mm rolling width, followed by the five slabs for Order 5 with 550 mm rolling width etc. The sequence of sorted slabs to be cast shown in FIG. 5 is hereinafter referred to as the "sorted base sequence of slabs to be cast".

Now, in step 206, the sorted base sequence of FIG. 5 is partitioned into a number of subsequences, which corresponds to the number of molds 126 of FIG. 1. Since the continuous casting system in FIG. 1 has four molds, the table in FIG. 5 is now partitioned into four subsequences. Each subsequence comprises an identical number of slabs to be cast. For this purpose, a directly linked set of slabs to be cast is selected from the first slab to be cast in the table in FIG. 5 and defined as subsequence 1. Subsequence 1 and all other subsequences comprise exactly eight slabs to be cast. These are marked with T1 in the following. This is followed by the next eight slabs to be cast in the table in FIG. 5, which are marked T2. This is followed by T3 and then T4, each comprising eight slabs to be cast. The resulting subsequences T1, T2, T3 and T4 are shown in FIG. 6.

After step 206 of partitioning into subsequences, in step 208 each of the subsequences is uniquely assigned to one of the strands, i.e. to one of the molds 126, whereby the assignment is carried out in such a way that the average slab width of the slabs to be cast, determined in the respective subsequence, decreases continuously from the inner strands to the outer strands. As a result, with respect to the continuous casting system of FIG. 1, the two inner strands have subsequence 1 and subsequence 2 with the large slab widths and the two outer strands have subsequences 3 and 4 with the smaller slab widths.

The result of the assignment of the individual subsequences to the strands or the strand assignment scheme is shown in FIG. 7.

Afterwards, in step 210, the slab widths of the slabs to be cast in the subsequences are adjusted for each of the subsequences, taking into account the tolerance specifications. The aim is to keep the width changes between immediately successive slabs to be cast in a subsequence in an interval which corresponds to the permissible specifications for the continuous casting system. In the following, the maximum permissible width difference between two immediately successive slabs is referred to as the "step value", whereby in the example in FIG. 1 this step value is assumed to be a maximum of 25 mm. For the sake of simplicity, in the following only the main strand 1 is discussed comprehensively in substrands 1 and 2 with subsequences 3 and 2, whereby calculations can be made in an analogous manner for the second main strand comprehensively in substrands 3 and 4 with subsequences 1 and 4.

If one now considers sub strand 1 with subsequence T3, there is a width jump between Order 1 and Order 4 in lines 1 and 2 with regard to the slabs in the rolling width from 520 to 470 mm. This clearly exceeds the mentioned 25 mm as step value. The same applies to the jump from Order 4 with a rolling width of 470 mm in line 7 and Order 7 with a rolling width of 430 mm. In order to adjust the slab widths in step 210, the width difference to the width of the following position is checked starting with the first position of the respective sorted subsequences. If the difference is greater than the step value, the width of the current slab or the current position is reduced to such an extent that the resulting difference in width corresponds to the step value. This is repeated cyclically. As a result, there are maximum jumps of 25 mm from the first position to the last position with regard to substrand 1. It should be noted that the exact way in which this adjustment of slab widths is made in order to take into account the maximum step values of the width jumps is possible in many ways. Ultimately, the result is decisive here, namely that the step value is not exceeded in a sequence from one slab to be cast to the next.

Since a special feature of the continuous casting system of FIG. 1 is that it is a so-called twin casting system in which only one common cutting system 134 is available for each pair of strands 128, it must be ensured that the slabs of the parallel lower strands 128, i.e. the slabs in lower strand 1 and 2 have identical lengths. However, this has not yet been taken into account in the previous adjustments. For this reason, the slab lengths are adjusted, which is outlined in general in step 212 and specifically in steps 214-216. Now that the slab widths have been adjusted in step 210, a corresponding minimum and maximum length of the slab can be calculated from the respective lower and upper limits of the slab weight for a given strand width. FIG. 1 shows the minimum slab length of 7849 mm and the maximum slab length of 10051 mm for the first line and Order 1 from the adjusted strand width of 500 mm. These calculations can now be performed for all slabs specified in the partial sequences. This corresponds to step 214 of FIG. 2. Now, for each pair of slabs to be cast in parallel, an average value is determined for the two minimum and maximum lengths of the slabs and an average length is calculated for both slabs. With regard to substrand 1 and subsequence T3, this results in an average slab length of 8757 mm, which is identical with substrand 2 (T2) and the first slab of order 5. Due to the different strand widths of 500 mm in one case and 550 mm in another one with respect to this first line, the corresponding slab weights of 8880 kg and 9768 kg also differ respectively.

It should also be noted here that it is irrelevant how exactly this mean slab length is calculated. It is possible, for example, that the target length (slab length) for the two slabs is the middle of the tolerance range of the lengths of the two slabs as follows: Target length=Length_min of substrand 1+(Length_max of substrand 2−Length_min of substrand 1)/2.

It should be noted that the minimum and maximum slab lengths can again be calculated using the density of steel, the constant thickness of the slab (e.g. 260 mm) and a certain tolerance deduction of e.g. 2% according to the known formula length=weight/(thickness×width×density).

The determination of the average value with respect to the two minimum and maximum lengths of the slabs and the determination of the length of the two slabs to the average value is carried out in FIG. 2 in step 216.

The method continues in step 218 by adjusting the slab weights to the amount of liquid steel actually available in a converter. If the slab weights resulting from the slab lengths determined in step 216 are summed up in FIG. 8, taking into account all substrands (including the not shown substrands 3 and 4), a total weight may be obtained which does not optimally take into account the quantity of liquid steel available from one or more converters. If, for example, the total weight is 275 t, but only 270 t of liquid steel can be made available using one converter, the slab weight or the slab length is now changed evenly across all the slabs of all the substrands until the resulting total weight corresponds to the desired target weight. Also here the corresponding tolerances regarding minimum and maximum slab width and minimum and maximum slab length have to be considered.

As an example, this can be realized in step 218, the adjustment of the slab weights, in such a way that a quotient of the resulting total weight and target weight is determined for all slabs of all substrands, whereby the change in the slab weight or slab length of each individual slab involves a multiplication of the slab weight or slab length with this coefficient. The relevant result is shown exemplarily in FIG. 9. As a result, the total weights of the substrands have increased in order to optimally achieve the target weight.

After step 218, the casting times are optimized in step 220, whereby the details of step 220 are outlined in steps 222-232. The aim is to increase the strand width while at the same time shortening the strand length in such a way that the weight is maintained and no tolerance violation takes place. The steps for optimizing the casting times are shown in detail in FIG. 2 in steps 222 to 232. For this purpose, the value Q1_i is first determined in step 222, where i indicates the respective pair of parallel slabs in relation to a pair of strands.

In FIG. 9, for example, i would indicate the first line for the slab pair Order 1 and Order 5 with respect to the substrands 1 and 2. Thus, the quotient of the maximum width (550 mm) and the width of the current slab (500 mm) is calculated and stored for Order 1. The quotient is also calculated as 580 mm by 550 mm for the first line or the first slab for substrand 1, Order 5.

After this calculation in step 222, a further quotient for the slabs of this pair of slabs is calculated in step 224. However, there is no "pre-slab" here, since the slabs indicated in the first line are the first slabs. In this respect, Q2 does not play a role here. Now the quotient Q3 is calculated in step 226 as the quotient of the width of the next slab plus the step value and the width of the current slab. With regard to substrand 1 this would be 475 mm+25/500 mm=1. After the quotients Q1, Q2 (not available, because there is no pre-slab) and Q3 have been calculated for the first line, the smallest value is now used for substrand 1 and substrand 2 together (since parallel slab) and the quotients calculated in this way are used for the first line (step 230). With this smallest quotient, the width of the current slab in line 1 for substrand 1 and substrand 2 is then multiplied in each case and the length of the current slab divided in each case (step 232).

The same is now done for the next line of substrands 1 and 2, i.e. the next pair of slabs. This time Q2 can be calculated, because e.g. with respect to line 2 of subline 1 the pre-slab has a width of 500 mm and the current slab has a width of 475 mm, so that Q2=500/475.

Ultimately, the steps of determining the different quotients, multiplying the widths and dividing the lengths, i.e. steps 222 to 232, can be performed iteratively, one after the other, for all the slabs of a pair of strands and for all the strands, and, at the end of these steps, this procedure can be repeated several times until either the width of the slabs is no longer changed or a certain number of iterations is reached or exceeded. The result is slabs to be cast which are optimized with regard to casting time by increasing the strand width within the tolerances without any tolerance violations.

The method ends in step 234 in which the control data 112 are transmitted to the continuous casting plant using the interfaces 104 and 116. The control data contain information regarding the sequence in which the slabs are to be produced with the corresponding calculated width and length. The control computer 114 can then control the control system in such a way that the slabs are produced accordingly.

LIST OF REFERENCE NUMBERS

100 Control device
101 Continuous casting system
102 Processor
104 Interface
106 Memory
108 Casting orders
110 Instructions
112 Control data
114 Control computer
116 Interface

118 Processor
120 Memory
122 Converter
124 Tundish
126 Mold
128 Pair of strands
130 Guide rollers
132 Slab
134 Cutting system

The invention claimed is:

1. Method for controlling a continuous casting system for producing slabs from a material, the continuous casting system having a plurality of molds for forming respective strands, the method comprising:

receiving a plurality of casting orders, each casting order comprising a demand quantity of the material, a respective slab width, and tolerance specifications with respect to the casting order, determining, for each of the casting orders, from the respective demand quantity and the respective slab width, a set of slabs to be cast with associated slab weights and slab widths, sorting all slabs to be cast of all sets of all casting orders according to a sorting criterion to obtain a sorted base sequence of slabs to be cast, the sorting criterion comprising the slab widths, uniformly partitioning the sorted base sequence into a number of subsequences, the number of subsequences corresponding to a number of the molds, adjusting, for each of the subsequences, the slab widths of the slabs to be cast of the subsequence under consideration of the tolerance specifications, wherein as a result of the adjusting the slab widths, width changes between two slabs to be cast immediately successively one after the other in the subsequence do not exceed a step value, wherein adjusted subsequences are obtained as a result of the adjusted slab widths, transmitting control data to the continuous casting system for producing the slabs to be cast determined in the adjusted subsequences, wherein in the control data for each of the subsequences an order of production of the slabs corresponds to the order in which the slabs to be cast are determined in a respective one of the adjusted subsequences.

2. Method of claim 1, wherein the continuous casting system is a multiple strand system with a plurality of strands arranged in parallel, wherein one of the molds is assigned to each strand, wherein controlling the continuous casting system is performed for parallel simultaneous production of the slabs to be cast determined in adjusted subsequences.

3. Method of claim 2, further comprising a unique assignment of each of the subsequences to one of the strands, the assignment being such that from inner strands to outer strands an average slab width of the slabs to be cast, determined in respective ones of the adjusted subsequences, continuously decreases.

4. Method according to claim 2, wherein each casting order comprises a KIM weight, wherein the tolerance specifications each comprise a lower limit and an upper limit with respect to the KIM weights, wherein the continuous casting system has, for each pair of strands, a common cutting system for the two strands for cutting slabs cast in parallel, wherein, for a pair of adjusted subsequences associated with one of the pairs of strands, the slabs specified at the same position of the adjusted subsequences form a pair of slabs to be cast in parallel, wherein the method further comprises, after the adjusting of the slab widths:

determining, for each slab to be cast of all the subsequences, from the adapted slab widths and the associated lower and upper limits of the KIM weight corresponding minimum and maximum lengths of the slab, for each pair of slabs to be cast in parallel, determining an average value with respect to the both minimum and maximum lengths of the slabs and assigning the average value the length of the both slabs.

5. Method of claim 1, wherein, due to the uniform partitioning, the number of slabs to be cast determined in respective ones of the adjusted subsequences is identical for all subsequences.

6. Method of claim 1, further comprising after the adjusting of the slab widths:

determining a total weight of all slabs to be cast of all the adjusted subsequences, comparing the total weight with a target weight for obtaining a comparison value, for all slabs to be cast determined in the adjusted subsequences, changing the slab weight or a slab length in a similar way based on the comparison value for obtaining updated adjusted subsequences, wherein in case when the thereby changed slab weight or the thereby changed slab length violates the tolerance specifications of the associated casting order no change in slab weight or slab length occurs, repeating the steps of the determining of the total weight, the comparing, and the changing of the slab weight or the slab length until the comparison value is within a threshold range.

7. Method of claim 6, wherein the target weight corresponds to at least one integer multiple of a weight obtainable by providing the material from a converter.

8. Method of claim 6, wherein the comparison value comprises a quotient of the total weight and the target weight, wherein the change in the slab weight or the slab length comprises multiplying the slab weight or the slab length by the quotient.

9. Method of claim 6, wherein the threshold range is a deviation of the total weight from the target weight of less than 3%.

10. Method of claim 1, further comprising after the adjusting of the slab widths for all of the slabs to be cast of all of the adjusted subsequences, changing the slab width of each slab in a similar way with concomitant shortening of its slab length while retaining its slab weight, wherein in case when the thereby changed slab width or the thereby changed slab length violates the tolerance specifications of the associated casting order no change in the slab width or the slab length occurs.

11. Method of claim 10, wherein the sorting criterion comprises a decreasing order of the slab widths, wherein the changing of the slab width of each slab in a similar way with concomitant shortening of its slab length comprises for all slabs of an adjusted subsequence respectively:

determining a first quotient of maximum allowable slab width and width of a current slab, determining a second quotient of the width of the slab immediately preceding the current slab in the subsequence and the width of the current slab, the second quotient being determined only if the current slab is not the first slab in the subsequence, determining a third quotient of the width of the slab immediately following the current slab in the subsequence plus the step value and the width of the current slab, wherein the third quotient is determined only if the current slab is not the last slab in the subsequence.

12. Method of claim 11, wherein the changing of the slab width of each slab in a similar way with concomitant shortening of its slab length comprises for all slabs of an adjusted subsequence respectively:

multiplying the width of the current slab and division of the length of the current slab by the smallest value of the first, second and third quotients, repeating the steps of the determining of the first, second and third quotients and the multiplying until either the width of the slabs no longer changes or a number of iterations is reached or exceeded.

13. Method of claim 11, wherein the continuous casting system has, for each pair of strands, a common cutting system for the two strands for cutting slabs cast in parallel, wherein, for a pair of adjusted subsequences associated with one of the pairs of strands, the slabs specified at the same position of the adjusted subsequences form a pair of slabs to be cast in parallel, wherein the determining of the first, second and third quotients is performed for each pair of current slabs of the slabs to be cast in parallel, wherein the changing of the slab width of each slab in a similar way with concomitant shortening of its slab length comprises for all the slabs of all the pairs of the adjusted subsequences respectively:

multiplying the widths of the pair of current slabs and dividing the lengths of the pair of current slabs by the smallest of the values of the first, second and third quotients determined with respect to the pair of current slabs, repeating the steps of the determining of the first, second and third quotients and the multiplying until either there is no change in the width of the slabs or until a number of iterations has been reached or exceeded.

14. Method of claim 1, wherein each casting order comprises a KIM weight, wherein the sorting criterion comprises a decreasing order of the slab widths as a primary criterion and the KIM weight as a secondary criterion, wherein the tolerance specifications each comprise a lower limit and an upper limit with respect to the slab widths and the KIM weights.

15. Method of claim 14, wherein the determining of the set of slabs to be cast comprises for each casting order:

determining a minimum slab weight from the lower limit of the slab width and the lower limit of the KIM weight, determining a maximum slab weight from the upper limit of the slab width and the upper limit of the KIM weight, determining of a mean value of the minimum and the maximum slab weight, determining the required number of slabs to be cast in order to just exceed the required amount of material at the mean value of the slab weight, wherein the set of slabs to be cast is formed by the number of slabs to be cast.

16. Method according to claim 1, wherein the adjusting of the slab widths of the slabs to be cast comprises the subsequence:

starting from the first or the last slab to be cast of the subsequence, determining the difference in width between the current slab and the slab immediately following the current slab in the subsequence, if the difference is greater than the step value, reducing the width of the current slab to such an extent that the resulting width difference to the immediately following slab corresponds to the step value, otherwise keeping the width of the current slab.

17. A non-transitory computer readable medium storing instructions, which when executed by a processor, configure the processor to perform the method of claim 1.

18. Control device for controlling a continuous casting system for producing slabs from a material, said continuous casting system comprising a plurality of molds for forming respective strands, said control device comprising a processor and a memory, said memory storing instructions executable by said processor, wherein execution of said instructions by said processor controls said control device to:

receive a plurality of casting orders, each casting order comprising a demand quantity of the material, a respective slab width, and tolerance specifications with respect to the casting order, determine, for each of the casting orders, from the respective demand quantity and the respective slab width, a set of slabs to be cast with associated slab weights and slab widths, sort all slabs to be cast of all sets of all casting orders according to a sorting criterion to obtain a sorted base sequence of slabs to be cast, the sorting criterion comprising the slab widths, uniformly partition the sorted base sequence into a number of subsequences, the number of subsequences corresponding to a number of the molds, adjust, for each of the subsequences, the slab widths of the slabs to be cast of the subsequence under consideration of the tolerance specifications, wherein as a result of the adjusting the slab widths, width changes between two slabs to be cast immediately successively one after the other in the subsequence do not exceed a step value, wherein adjusted subsequences are obtained as a result of the adjusted slab widths, transmit control data to the continuous casting system for producing the slabs to be cast determined in the adjusted subsequences, wherein in the control data for each of the subsequences the order of production of the slabs corresponds to the order in which the slabs to be cast are determined in a respective one of the adjusted subsequences.

* * * * *